US005078517A

United States Patent [19]

Hiroshi et al.

[11] Patent Number: 5,078,517

[45] Date of Patent: Jan. 7, 1992

[54] WIRE-DOT IMPACT PRINTER WITH HEAD GAP ADJUSTMENT RESPONSIVE TO MEASURED WIRE MOVEMENT

[75] Inventors: Kikuchi Hiroshi; Tanuma Jiro; Ishimizu Hideaki; Komori Chichiro, all of Tokyo, Japan

[73] Assignee: Oki Electric Industry Co., Ltd., Tokyo, Japan

[21] Appl. No.: 392,620

[22] PCT Filed: Nov. 25, 1988

[86] PCT No.: PCT/JP88/01191

§ 371 Date: Jul. 21, 1989

§ 102(e) Date: Jul. 21, 1989

[87] PCT Pub. No.: WO89/04766

PCT Pub. Date: Jun. 1, 1989

[30] Foreign Application Priority Data

Nov. 27, 1987 [JP] Japan ..... 62-301193

[51] Int. Cl.[5] ..... B41J 25/308

[52] U.S. Cl. ..... 400/59; 400/124; 400/703

[58] Field of Search ..... 400/55, 56, 57, 58, 400/59, 60, 124, 703, 704

[56] References Cited

U.S. PATENT DOCUMENTS

| | | | |
|---|---|---|---|
| 3,983,803 | 10/1976 | Thomas et al. | 400/56 |
| 4,173,927 | 11/1979 | Van Kempen | 400/56 |
| 4,192,230 | 3/1980 | Blom et al. | 400/124 |
| 4,657,415 | 4/1987 | Kikuchi et al. | 400/59 |
| 4,940,343 | 7/1990 | Kikuchi et al. | 400/124 |

FOREIGN PATENT DOCUMENTS

| | | | |
|---|---|---|---|
| 129758 | 11/1982 | Japan | 400/124 |
| 22183 | 2/1983 | Japan | 400/124 |
| 72468 | 4/1983 | Japan | 400/124 |
| 2864 | 1/1984 | Japan | 400/124 |
| 78659 | 4/1986 | Japan | 400/124 |
| 171377 | 8/1986 | Japan | 400/55 |

OTHER PUBLICATIONS

A. G. Gianmoena et al., "Dynamic Platen-to-Head Gap Measuring Tool", *IBM Tech. Disc. Bull.*, vol. 25, No. 10, p. 5176, Mar. 1983.

*Primary Examiner*—David A. Wiecking

*Attorney, Agent, or Firm*—Wenderoth, Lind & Ponack

[57] ABSTRACT

An interval between a wire-dot printing head and a printing medium in a wire-dot impact printer, wherein the wire-dot printing head is provided with a plurality of printing wires which strike against the printing medium, is adjustably controlled by an interval adjustment device and a control device. Displacements of the printing wires are detected when they are operated, and the interval between the wire-dot printing head and the printing medium is adjusted appropriately as a function of the resultant value of such detection. It is possible to adjust the interval between the wire-dot printing head and the printing medium in a short time so that the printing operation can be carried out a high speed and with high quality.

12 Claims, 10 Drawing Sheets

WIRE-DOT IMPACT PRINTER WITH HEAD GAP ADJUSTMENT RESPONSIVE TO MEASURED WIRE MOVEMENT

FIELD OF THE INVENTION

The present invention relates to a wire dot printer having a wire-dot printing head provided with a printing wire which strikes onto a printing medium, especially to a system for controlling an interval between the wire-dot printing head and the printing medium.

BACKGROUND OF THE INVENTION

A conventional wire-dot printing head is illustrated in FIG. 1 that shows a general arrangement of a prior art printing mechanism. Therein, designated at 101 is a wire-dot printing head having a printing wire (not shown), 102 is a carriage for supporting the wire-dot printing head 101, 103 and 104 are guide shafts for supporting the carriage 102 for movement in directions A and 105 is a platen for feeding printing paper. The carriage 102 moves in the directions A upon reception of signals from a spacing motor (not shown), thereby moving the wire-dot printing head 101 in the directions of the width of the printing paper, while the platen 105 rotates upon reception of signals from a line feed motor (not shown), thereby feeding the printing paper in a direction crossing the width direction. A printing operation can be carried out by the printing dot wire striking onto the printing paper at a position to be printed via, for example, an ink ribbon while the wire-dot printing head 101 is moved in the width direction of the printing paper at a predetermined speed. When the wire-dot printing head 101 has completed one line of printing after reaching an end position of the printing paper in the width direction, the platen 105 is rotated to feed the printing paper in the longitudinal direction thereof for a length sufficient for a new line of printing while the wire-dot printing head 101 returns to an original position, so that the printing wire starts to strike onto the area of the printing paper for the next line of pointing.

In a printer having a printing wire for striking onto the printing paper to effect the printing operation in such a manner, the force to be applied to the printing paper affects the printing quality and varies according to an interval (head gap g) between the wire-dot printing head 101 and the printing paper. There is provided in the prior art printer a manual lever (not shown) so that the head gap g can be varied depending on the thickness of the printing paper. Frequently there occurs an erroneous operation of the manual lever by an operator which causes an inferior printing operation. This results in a loss of printing paper and/or downtime of the printer.

There has been proposed an apparatus for automatically adjusting the head gap g without the need for manual adjustment. FIG. 2 shows a general arrangement of a printer having such automatic adjusting mechanism, FIG. 3 is an enlarged side elevational view of a main portion of FIG. 2, and FIG. 4 is a view illustrating a primary portion of the arrangement FIG. 3. In these figures, the elements that are the same as those of FIG. 1 are denoted as the same reference numerals.

In FIG. 2, the guide shaft 103 is attached to side frames 106, 107 via eccentric bushes 108, 109 which are rotatably supported by the side frames. As a means for rotating the eccentric bushes 108, 109, there is a mechanism as shown in FIGS. 2 and 4 in which the rotary drive force of a pulse motor 110 is transmitted to a gear 112 via a gear 111 provided on a rotary shaft of the pulse motor 110, to thereby rotate the eccentric bush 108 together with the gear 112. On the other hand, the carriage 102 has a holding portion 102*a* having a U-shape in cross section as shown in FIG. 3 and is movable in the directions of an arrow B to vary the head gap g. During an actual adjustment operation, the eccentric bushes 108, 109 are rotated until the wire-dot printing head 101 is brought into contact with the platen 105 to allow the pulse motor 110 to be in a step out state, and then the pulse motor 110 is rotated oppositely for a given pulse number corresponding to a desired head gap g.

However, inasmuch as the wire-dot printing head 101 is brought into contact with the platen 105 every time the head gap g is adjusted, there occurs the problem that adjustment of the head gap g takes substantial time. Further, the printing operation is slowed since the adjustment of the head gap g is carried out every time the printing paper is changed or is repeated every time the printing paper is changed in case a signal paper is inserted into the head gap g.

The head gap g is normally adjusted at one end portion of the platen 105 in view of the restricted adjustment time. Hence, no attention was paid to the possibilities of a variation of the head gap g caused by an error of the diameter of the platen 105, a deflection of the guide shaft 103 or the platen 105 or an eccentric phase difference of the eccentric bushes 108, 109. There are generated other problems in that the head gap g cannot be correctly set if a step out position of the pulse motor 110 is varied due to a variation of the pressing force against the platen 105 caused by the step out torque of the pulse motor 110, a variation of the load torque of other ports of the transmission mechanism, a deformation of the platen 105 that is made of an elastic material, or flexibility of the supporting shaft of the platen 105, etc., at the time when the head gap g is adjusted on the basis of the step out position of the pulse motor.

Furthermore, it is impossible to set the head gap g in accordance with a partial variation of the thickness of the printing medium relative to a printing medium having a different thickness such as an envelope, a bank book or a printing medium having perforations.

Accordingly, it is an object of the present invention to provide a wire-dot impact printer capable of solving the problems of the prior art printer, and capable of carrying out an appropriate adjustment of the head gap to effect a printing operation with high quality.

SUMMARY OF THE PRESENT INVENTION

To achieve the above object, the wire-dot impact printer according to the present invention comprises an interval adjusting means for adjusting the interval between the wire-dot printing head and the printing medium, a displacement detector means for detecting the displacement of a printing wire provided at the wire-dot printing head, and a controller for variably controlling the interval between the wire-dot printing head and the printing medium at an appropriate value on the reception of a signal issued as the result of the detection by the displacement detector means.

The wire-dot impact printer having this arrangement can adjust the head gap g within a short period of time with accuracy and can print at high speed and with high quality.

DETAILED DESCRIPTION OF THE INVENTION

Figure 5:
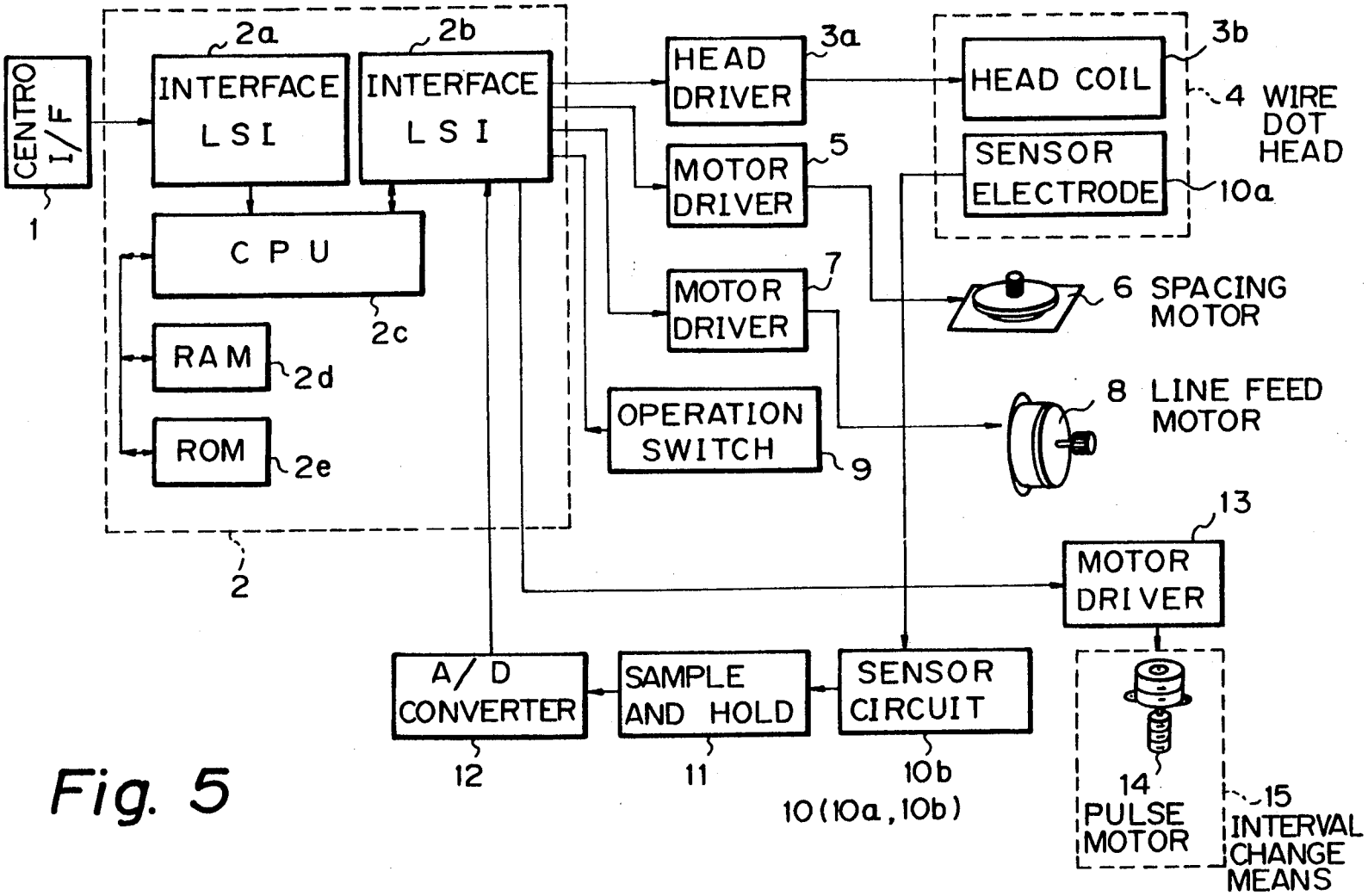
FIG. 5 is a block diagram of a wire-dot impact printer according to an embodiment of the present invention.

FIG. 5 is a block diagram showing an arrangement of a wire-dot impact printer according to the present invention. Therein, designated at 1 is a centro I/F for receiving printing data, 2 is a control circuit for controlling the constituents of the printer, 3*a* is a head driver, 3*b* is a head coil, 4 is a wire-dot printing head, 5 is a motor driver, 6 is a spacing motor, 7 is a motor driver, 8 is a line feed motor, 9 is an operation switch, 10*a* is a sensor electrode, and 10*b* is an electrostatic capacitor sensor (hereafter referred to as a sensor circuit). The electrode 10*a* and the sensor circuit 10*b* constitute a displacement detector means 10. Designated at 11 is a sample and hold circuit, 12 is an A/D converter, 13 is a motor driver, 14 is a pulse motor, and 15 is an interval adjusting means as a drive motor for adjusting the head gap.

The arrangement of the present invention is different from that of the prior art in that the present invention has the displacement detector means 10 and the interval adjusting means 15, and that the controller circuit 2 receives head gap data detected by the displacement detector means 10 and issues an instruction for adjusting the head gap to the interval adjusting means 15. This different arrangement will be described in detail hereinafter.

The control circuit 2 comprises an input interface LSI 2*a*, an output interface LSI 2*b*, a CPU 2*c*, a RAM 2*d* for storing the printing data and executing the printing data, and a ROM 2*e* for storing a control program or a printing phonto (data for displaying the shape of the character by dot).

Figure 6:
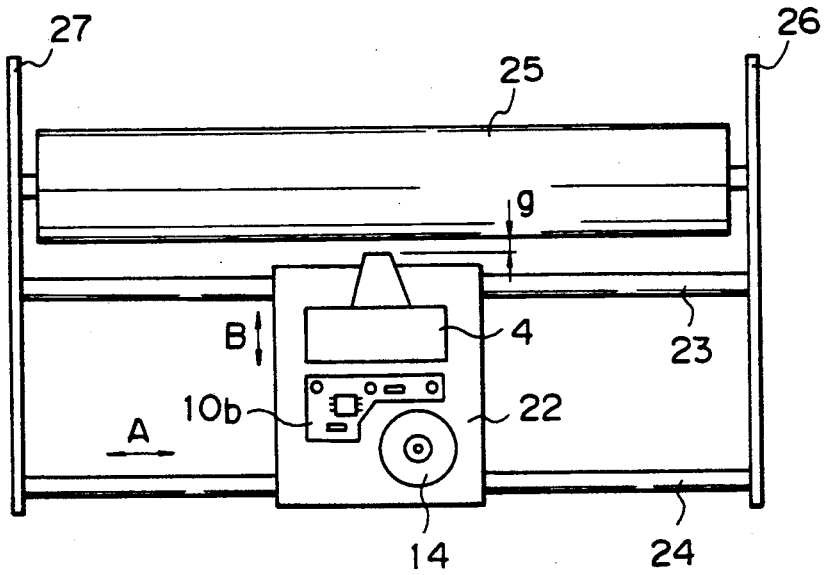
FIG. 6 is a plan view of a general arrangement of a printing mechanism of this embodiment of the present invention.

Next, the interval adjusting means 15 will be described hereinafter. FIG. 6 is a plan view of a printing mechanism according to an embodiment of the present invention. Therein, designated at 4 is a wire-dot printing head, 22 is a carriage for supporting the wire-dot printing head, 23 and 24 are guide shafts for guiding movement of the carriage 22 in directions A, 25 is a platen for feeding printing paper, and 26 and 27 are side frames supporting the guide shafts 23, 24. The carriage 22 receives power from the spacing motor 6 (FIG. 5) and moves in the directions A to move the wire-dot printing head 4 in the width direction of the printing paper. The platen 25 receives power from the line feed motor 8 (FIG. 5) to rotate for thereby feeding the printing paper in the longitudinal direction thereof crossing the width direction thereof. During a printing operation, the printing wire strikes onto the printing paper at a predetermined position thereof via an ink ribbon while the wire-dot printing head is moved at a predetermined speed in the width direction of the printing paper. At the time when the one line of printing is completed after the wire-dot printing head 4 reaches the end position of such line in the width direction of the printing paper, the platen 25 rotates to feed the printing paper for a distance for a new line while the wire-dot printing head 4 returns to its original position. Then the printing wire carries out the next line of the printing operation.

Figure 7:
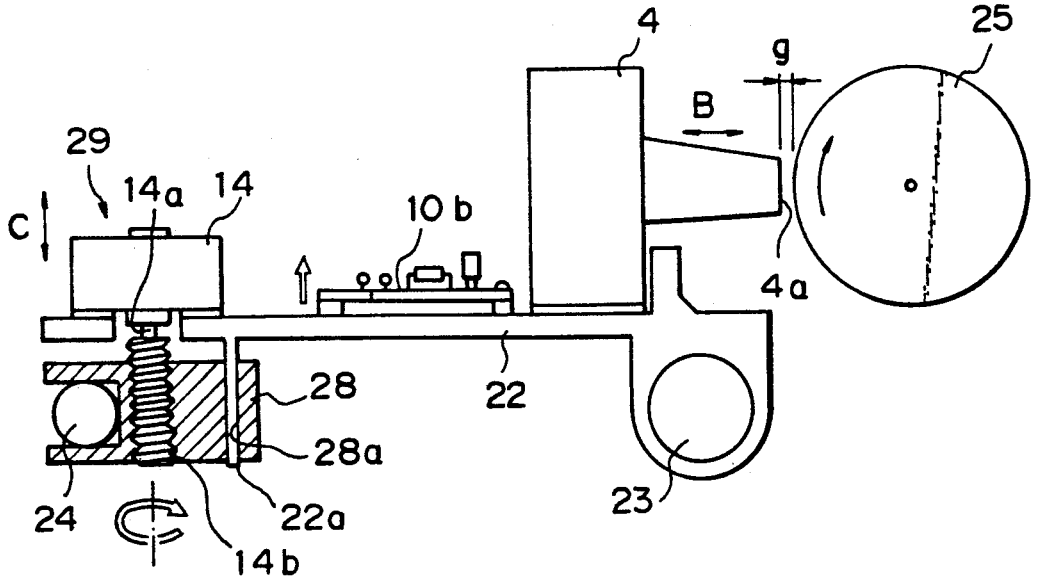
FIG. 7 is a side elevation of the structure of FIG. 6.

An arrangement as shown in FIG. 7 is adopted as the interval adjusting means 15 according to this embodiment of the present invention. Although the carriage 22 moves along the two guide shafts 23, 24, the carriage 22 according to the present invention is not held directly by the two guide shafts 23, 24 but has at the rear portion thereof a height adjusting mechanism provided at the guide shaft 24. That is, fixed at the rear portion of the carriage 22 is pulse motor 14 having a rotary shaft 14*a* which is directly connected with a worm screw gear 14*b* protruding under the carriage 22. The carriage 22 has a guide pin 22*a* protruding from a lower surface thereof at the rear portion thereof. The guide pin 22*a* is vertically slidably held within a guide hole 28*a* of a slider 28 which is movably supported by the guide shaft 24 so that the guide pin 22*a* can be vertically moved relative to slider 28. The slider 28 has a gear which is engaged with the screw gear 14*b*. Accordingly, the carriage 22 is supported by the guide shaft 24 via the slider 28, the screw gear 14*b*, the rotary shaft 14*a* and the pulse motor 14. As a result, when the pulse motor 14 is rotated, the rear portion of the carriage 22 is vertically moved in the directions of the arrow C (in directions parallel to the guide pin 22*a* guided in the guide hole 28*a*) so that the carriage 22 is rotated about the guide shaft 23. Accompanied by this movement, the head gap g between the tip end 4*a* of the wire-dot printing head 4 and the platen 25 can be varied. The head gap g also can be varied by a means other than that of the present invention, such as by means to move the platen 25, etc.

Figure 8:
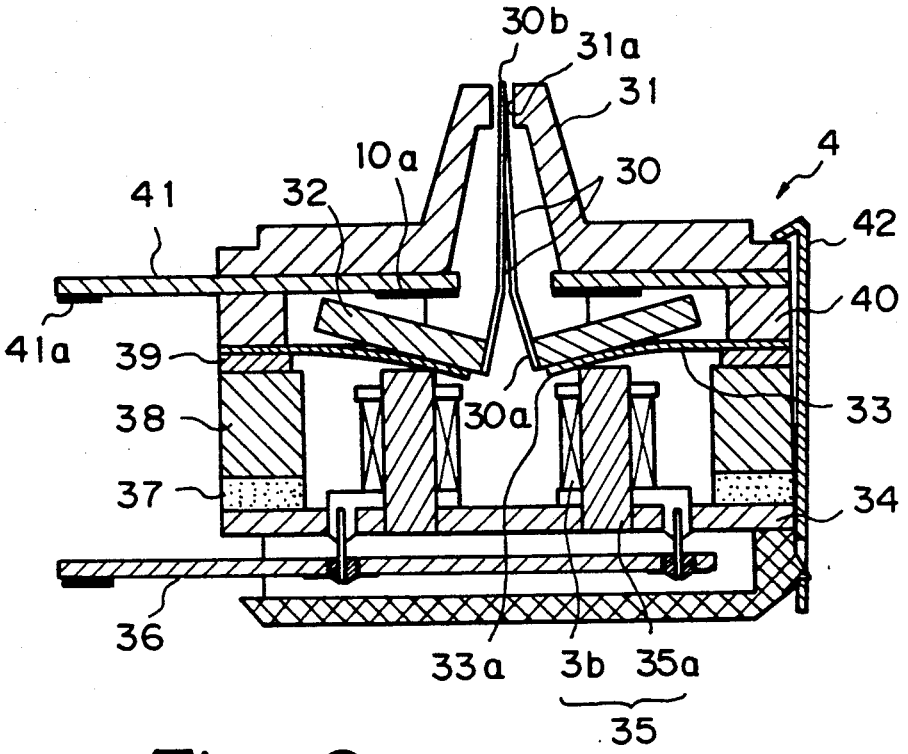
FIG. 8 is a longitudinal cross-sectional view of the wire-dot impact printer of this embodiment of the present invention.

The displacement detector means 10 for detecting the displacement of the printing wire will be described next. FIG. 8 is a cross-sectional view of the wire-dot printing head 4. Therein, designated at 30 is a plurality of print wires provided at the wire-dot printing head 4 (only two print wires are illustrated), 31 is a guide frame having a guide groove 31*a* for guiding the printing wires, 32 are armatures made of a magnetic material, and 33 are plate springs for supporting the armatures 32. On the other hand, designated at 34 is a base, 35 is an electromagnet having a core 35*a* and head coil 3*b* wound around the periphery of the core 35*a*, 36 is a printed circuit board having print wiring thereon and connector terminals for supplying power from a power source to the electromagnet 35, 37 is a permanent magnet, 38 is a rock, 39 is a spacer, 40 is a yoke, 41 is a printed circuit board, and 42 is a clamp. The clamp 42 presses and holds the base 34, the permanent magnet 37, the rack 38, the spacer 39, the plate springs 33, the yoke 40, the printed circuit board 41, and the guide frame 31 in a manner such that these members are assembled one on the other in turn in such order and are integrated.

Each armature 32 is supported at a free end 33*a* of a respective plate spring 33, while a base end 30*a* of a respective one of the print wires 30 is fixedly mounted on a distal end 32*a* of the armature 32. A distal end 30*b* of the print wire 30 is guided by the frame groove 31*a* of the guide frame 31 so as to strike against a predetermined position of the printing paper (not shown).

Figure 9:
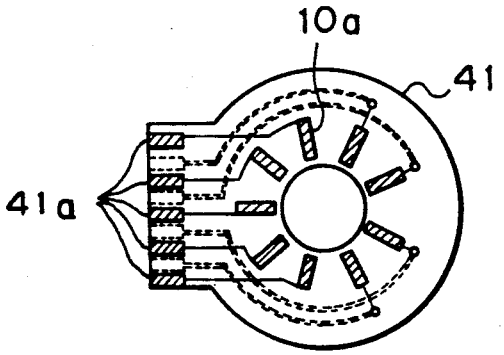
FIG. 9 is a plan view of a printed circuit board.
Figure 10:
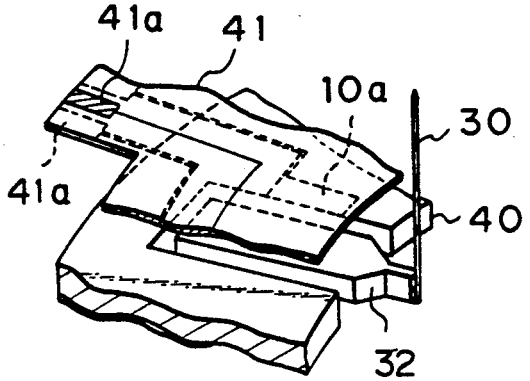
FIG. 10 is a perspective view of a main portion of the printed circuit board of FIG. 9.

FIG. 9 is a plan view of the printed circuit board 41, and FIG. 10 is a perspective view of a main portion of the printed circuit board 41. The printed circuit board 41 includes sensor electrodes 10*a* which are composed of copper foil patterns, positioned opposite the armatures 32 and connected to connector terminals 41*a* of the printed circuit 41. The printed circuit board 41 is coated by an insulting film to provide insulation from the yoke 40 for thereby generating electrostatic capacitance in the interval between the sensor electrodes 10*a* and the armatures 32. The larger the intervals between the sensor electrodes 10*a* and the armatures 32, the smaller will be the value of the capacitance, while the smaller the interval the greater will be the capacitance value.

With this arrangement of the wire-dot impact printer having the wire-dot printing head 4, at the time when the head coil 3*b* is deenergized, the armature 32 is attracted toward the base plate 34 (downward direction in FIG. 8) by the attraction force of the permanent magnet 37 against the resilient force of the plate spring 33. When the head coil 3*b* is energized, the magnet flux of the permanent magnet 37 is cancelled by the magnet flux of the electromagnet 35 to release the armature 32 from the attraction force of the permanent magnet 37 to move the armature 32 toward guide frame 31 (upward direction in FIG. 8) by the resilient force of the plate spring 33. The yoke 40 forms a part of the magnetic circuit of the electromagnet 35 and functions to insulate mutual interference of the sensor electrodes 10*a*.

Figure 11:
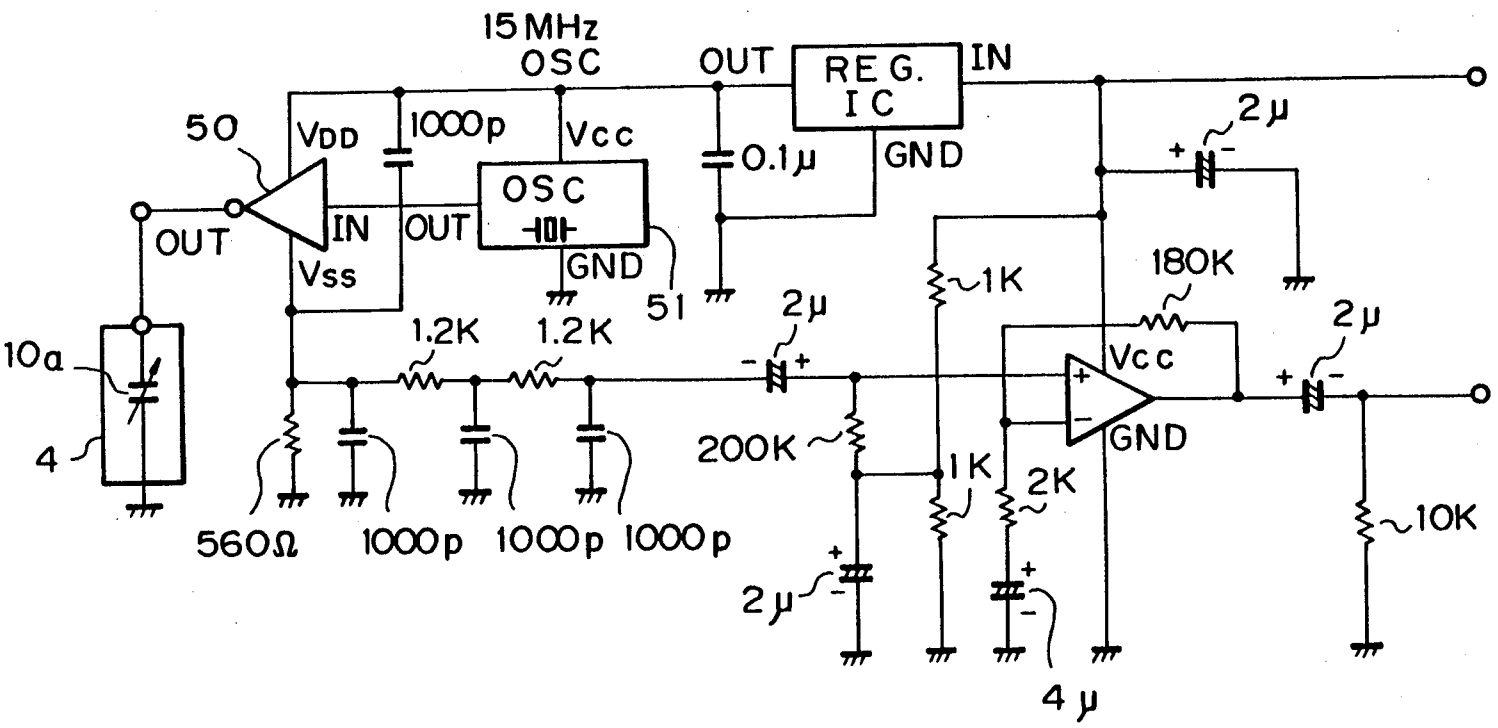
FIG. 11 is a circuit diagram of an electrostatic capacitor sensor circuit.
Figure 12:
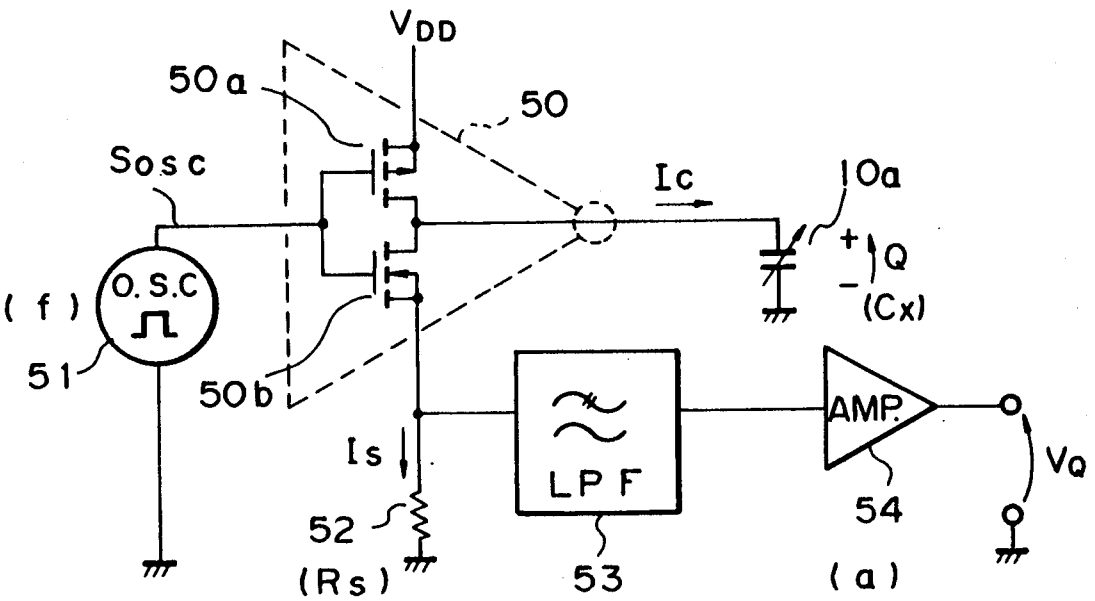
FIG. 12 is a circuit diagram of assistance in explaining a principle of FIG. 11.
Figure 13:
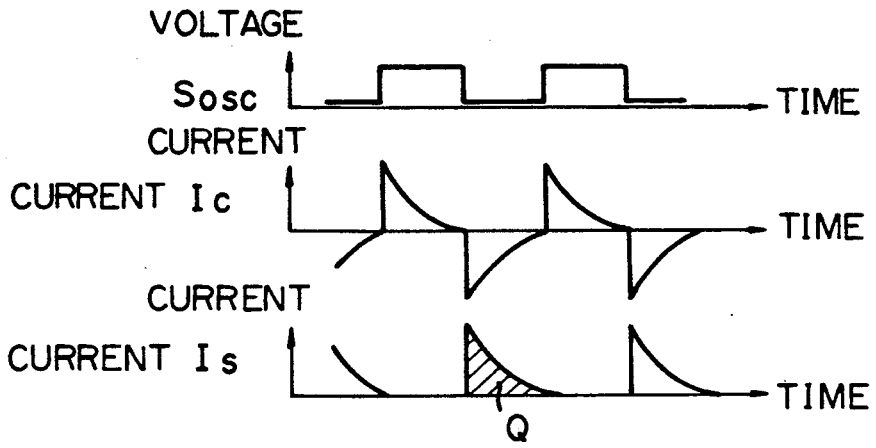
FIG. 13 is a graph of waveforms of operation of FIG. 12.

FIG. 11 is a circuit diagram of the sensor circuit 10*b*, FIG. 12 is a circuit diagram explaining a principle of FIG. 11, and FIG. 13 illustrates waveforms of operation of FIG. 12. In FIG. 12, designated at 50 is a digital IC (MSM74HCU04 made of Oki Electric Industry Co., Ltd.), and 50*a* and 50*b* are MOSFET of internal equivalent circuits (field effector transistors). Designated at 51 is an oscillator, 52 is a resistor, 53 is an integrator, and 54 is an ac amplifier. With the circuit arrangement set forth above, the sensor electrode 10*a* is connected to an output terminal of the digital IC 50, while a square shaped signal $S_{OSC}$ shown in FIG. 13 from the oscillator 51 is applied to the input terminal of the digital IC 50 for thereby permitting a current $I_C$ to flow at the output terminal of the digital IC 50. The current $I_C$ is a charging/discharging current to be supplied to the sensor electrode 10*a* so that the FETs 50*a*, 50*b* are alternately turned on or off on the reception of the signal $S_{OSC}$. A discharging current $I_S$ flows to ground via the FET 50*b* and the resistor 52. A value of the integration of the discharging current $I_S$ for one periodic cycle corresponds to quantity Q of an electric charge to be substantially charged in the sensor electrode 10*a*. Assuming that an electrocapacitance of the sensor electrode 10*a* is $C_X$, an oscillation frequency of the oscillator 51 is f, a resistance value of the resistor 52 is $R_S$, an amplification factor of the amplifier 54 is a times, the mean value of the current $I_S$ will be $f\,Q=f.C_X.V_{DD}$, while the output voltage of the amplifier will be $V=C_X.R_S.a.f.V_{DD}$, whereby a desired voltage $V_Q$ proportional to the electrocapacitance $C_X$ is produced. However, actually the amplifier 54 is composed of an ac amplifier so that an offset (dc) such as the distribution capacitance, etc., existing other than the sensor electrode 10*a* is cut off and only displacement of the printing wire 30 is produced.

Figure 14:
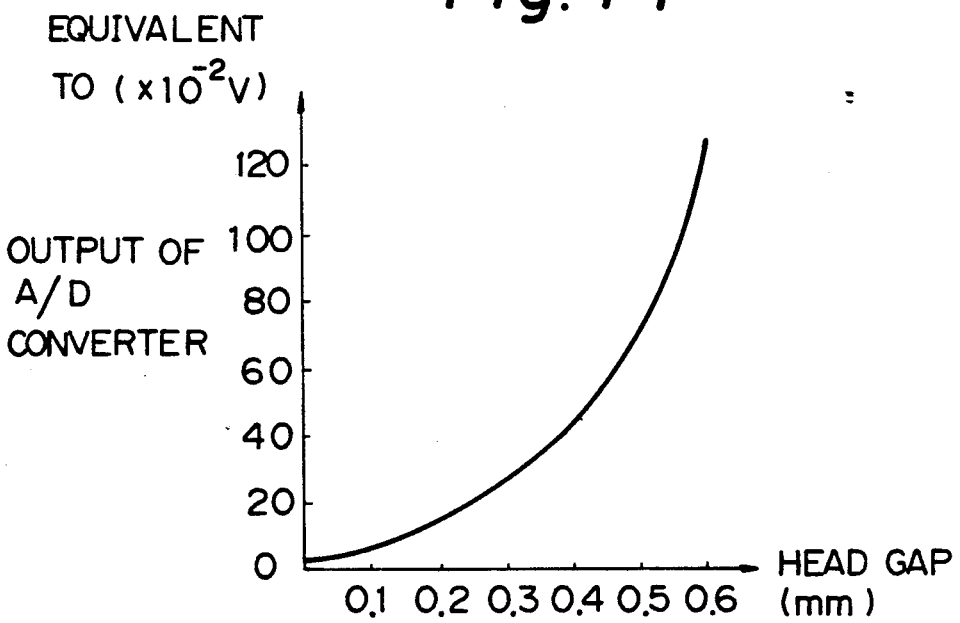
FIG. 14 is a graph showing a variation of the output of an A/D converter relative to a displacement of a printing wire.
Figure 15A:
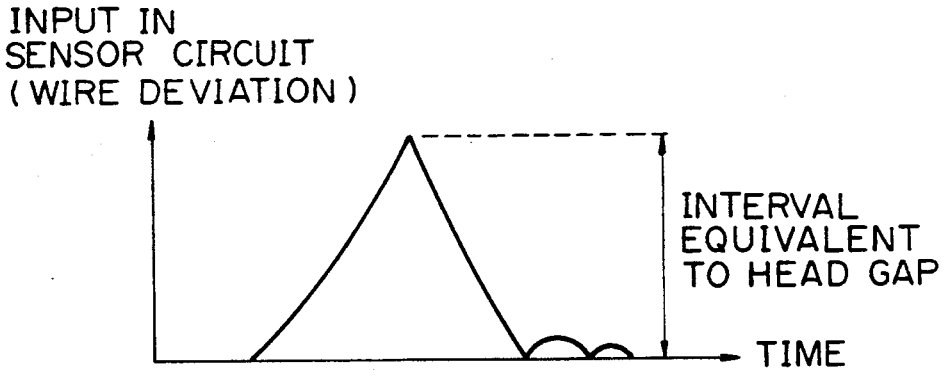
FIGS. 15(*a*) and 15(*b*) are graphs of an input waveform and an output waveform of respectively of the electrostatic capacitor sensor circuit.
Figure 15B:
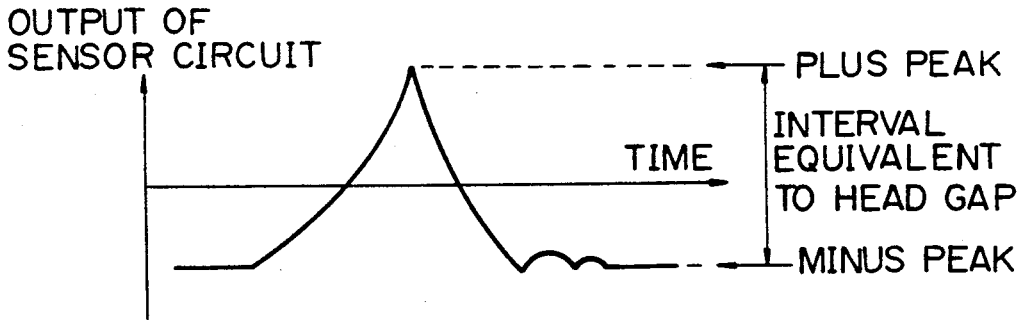

Concretely, the output waveform of the sensor electrode 10*a* is illustrated in FIG. 15(*a*) while the output waveform of the sensor electrode 10*b* is illustrated in FIG. 15(*b*). Here, an interval between the plus peak and the minus peak in FIG. 15(*b*) corresponds to the head gap g. To know the value of the head gap g, the plus peak value and the minus peak value of the output of the sensor circuit 10*b* are held by the sample and hold circuit 11 and the difference of the voltage between the plus peak value and the minus peak value is converted into a digital value by the A/D converter 12 having a difference input. The head gap g thus subjected to digital conversion is applied to the CPU 2*c* via the interface LSI 2*b*. Accordingly, the relationship between the displacement of the printing wire 30 and the output voltage $V_Q$ of the sensor circuit 10*b* is illustrated in a graph of FIG. 14 since the electrostatic capacitance of the sensor electrode 10*a* is approximately inversely proportional to the distance between the sensor electrode 10*a* and the armature 32.

Figure 16:
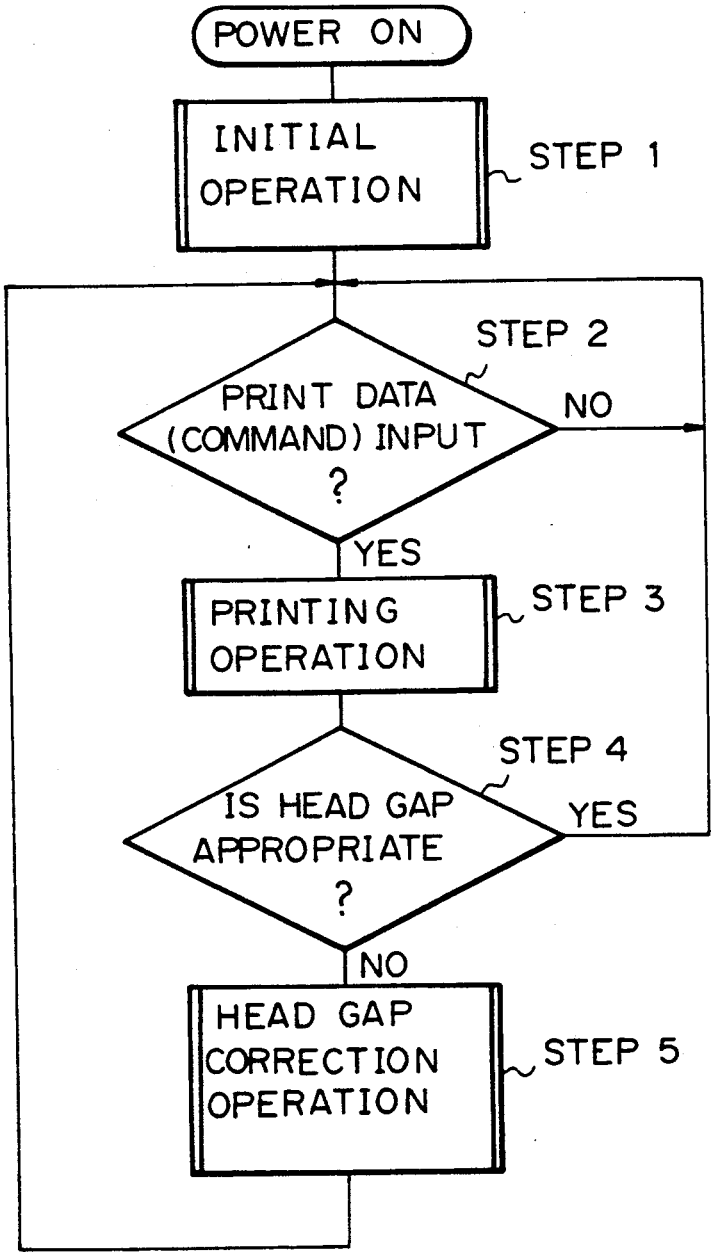
FIG. 16 is a flow chart showing an operation of the wire-dot impact printer according to this embodiment of the present invention.

Operation of the embodiment of the present invention having the arrangement set forth above will be described with reference to the flow chart of FIG. 16. First, after the power supply of the printer is supplied an initial operation is carried out as Step 1. The initial operation is an initial setting of the head gap g which is carried out in the same manner as that of the prior art, namely, the wire-dot printing head 4 is caused to strike against the platen 25 to step out the pulse motor 14, and thereafter the pulse motor is reversely rotated for a predetermined pulse number to obtain a desired head gap g. In a succeeding Step 2, the CPU 2*c* judges whether the printing data is supplied or not. If supplied, the process goes to Step 3 where the CPU 2*c* supplies a control signal via the LSI 2*b* to the head driver 3*a*, the motor drivers 5, 7 to actuate the printing wire 30 of the wire-dot printing head 4, the spacing motor 6 and the line feed motor 8, etc. for effecting the printing operation. At Step 4, the head gap g is detected as a function of the displacement of the printing wires 30 at the printing operation and judged to be appropriate or not. If the head gap is judged to be appropriate, the process is returned to Step 2. If judged to be inappropriate, the process goes to Step 5. At Step 5, the control signal is supplied from the CPU 2*c* to the motor driver 13 via the interface LSI 2*b* to actuate the pulse motor 14 for adjusting the head gap g and thereafter the process is returned to Step 2. Actually if an appropriate value of the head gap g is 0.45 mm, the value within a predetermined value range (for example, within 045 to 0.48 mm) is judged to be an appropriate head gap g. If there occurs a case where the correction value of the head gap g is too large for any dot printing operation, the correction operations are carried out over several printing operations.

Figure 1:
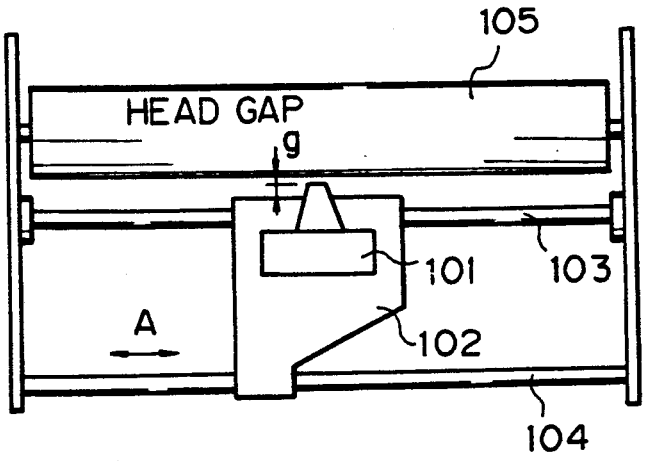
Fig. 1 Prior Art
FIG. 1 is a plan view of a general arrangement of a prior art printer.
Figure 2:
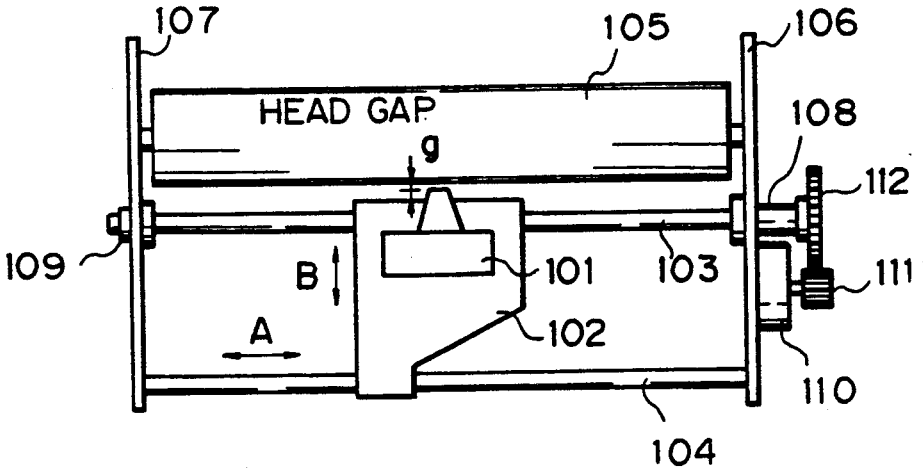
Fig. 2 Prior Art
FIG. 2 is a plan view of a general arrangement of another prior art printer.
Figure 3:
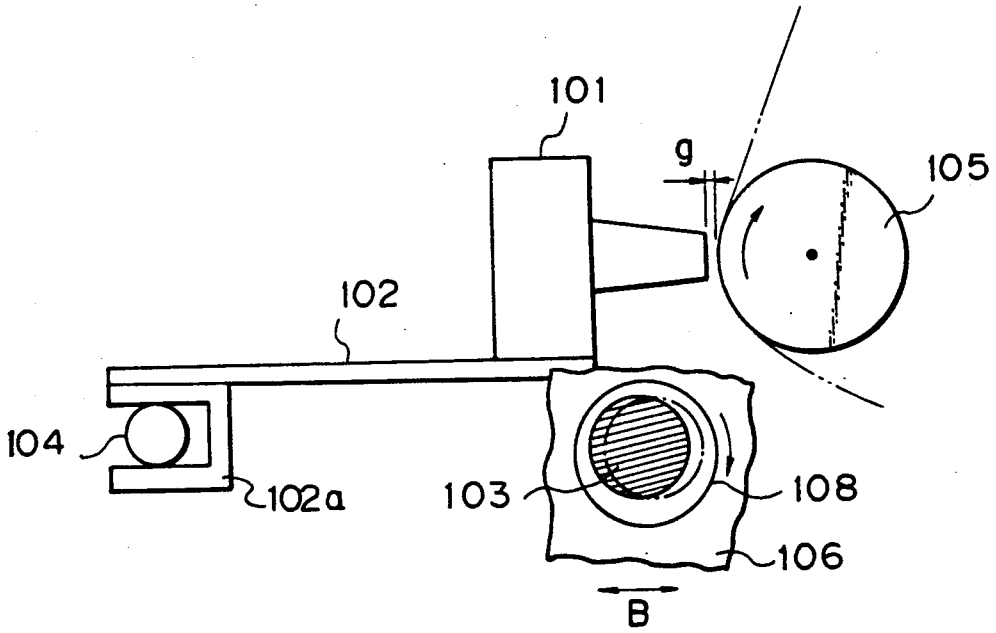
Fig. 3 Prior Art
FIG. 3 is an enlarged side elevation of a main portion of the printer of FIG. 2.
Figure 4:
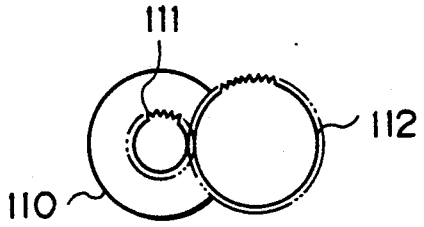
Fig. 4 Prior Art
FIG. 4 is a side view illustrating a gear portion of the structure of FIG. 3.

As mentioned above, the above embodiment of the present invention is provided with a means for detecting the displacement of the printing wires 30. Inasmuch as the head gap g is adjusted on the basis of the data of the displacement of the printing wires 30, it is not necessary to determine the initial position by striking the printing head against the platen, as occurs in the prior art arrangement illustrated in FIG. 3, at the time of adjustment of the head gap g. Accordingly, the adjustment of the head gap g can be effected within a short period of time to achieve high speed printing. Due to the reduction of time involved in the adjustment of the head gap g, it is possible to correct the head gap g for every one-dot printing thereby maintaining the head gap at all times at an optimum and achieving clear and high quality printing.

As mentioned above, with the wire-dot impact printer according to the present invention it is possible to omit the extra operation that an initial position is determined by moving the printing head against the platen so that the time required for adjustment of the head is reduced, thereby achieving high speed printing.

In addition to reduction of the time required to adjust the head gap, it is possible to finely correct the head gap, for example, at every one-dot printing, and thereby maintain the head gap at all times at an optimum. Accordingly, even with printing mediums having different thickness, such as an envelope, a bankbook, etc., the head gap will be kept at the optimum and thereby assure high speed and high quality printing.

As set forth above in detail, the wire-dot impact printer according to the present invention has an industrial applicability capable of adjusting the head gap in a short time and of printing with high speed and high quality.

What is claimed is:

1. A wire-dot impact printer comprising:

a wire-dot printing head adapted to be spaced at a predetermined interval relative to a printing medium, said wire-dot printing head including a plurality of print wires each having a tip end capable of performing a printing operation by striking against the printing medium during a printing operation;

interval adjusting means for moving said wire-dot printing head relative to the printing medium and thereby for adjusting the interval therebetween, said interval adjusting means comprising a carriage supporting said wire-dot printing head, a motor fixed to said carriage and having a rotatable drive shaft, a gear connected to said drive shaft, a fixedly positioned support shaft, and a slider movable along said support shaft and having means meshing with said gear, such that operation of said motor rotates said gear and moves said gear and thereby said motor, said carriage and said wire-dot printing head relative to said slider and said support shaft;

displacement detector means for detecting displacement of said print wires during the printing operation; and control means, operatively associated with said displacement detector means and with said interval adjusting means, for supplying to said interval adjusting means a control signal to adjust the interval between said wire-dot printing head and the printing medium to the predetermined interval as a function of result of the displacement of said print wires detected by said displacement detector means.

2. A printer as claimed in claim 1, wherein said displacement detector means comprises an armature connected to said print wire and movable therewith during the printing operation, an electrode adjacent said armature, and means for detecting changes in capacitance between said armature and said electrode.

3. A printer as claimed in claim 2, wherein said electrode is formed on a printed circuit board.

4. A printer as claimed in claim 3, wherein said printed circuit board has therethrough a outer opening, and said electrode extends radially adjacent said opening.

5. A printer as claimed in claim 4, wherein said electrode faces said armature.

6. A printer as claimed in claim 1, wherein said gear comprises a worm screw gear.

7. A printer as claimed in claim 1, wherein said motor is attached adjacent a first edge of said carriage, and said wire-dot printing head is mounted on said carriage adjacent an opposite second edge thereof.

8. A printer as claimed in claim 7, wherein said carriage is mounted adjacent said second edge thereof on another support shaft for pivotal movement thereabout.

9. A printer as claimed in claim 1, wherein said displacement detector means comprises an armature connected to said print wire and movable therewith during the printing operation, an electrode adjacent said armature, and means for detecting changes in capacitance between said armature and said electrode.

10. A printer as claimed in claim 9, wherein said electrode is formed on a printed circuit board.

11. A printer as claimed in claim 10, wherein said printed circuit board has therethrough a outer opening, and said electrode extends radially adjacent said opening.

12. A printer as claimed in claim 11, wherein said electrode faces said armature.

* * * * *

UNITED STATES PATENT AND TRADEMARK OFFICE

CERTIFICATE OF CORRECTION

PATENT NO. : 5,078,517

DATED : January 7, 1992

INVENTOR(S) : Hiroshi KIKUCHI et al.

It is certified that error appears in the above-identified patent and that said Letters Patent is hereby corrected as shown below:

On the Title page,

Section [19], "Hiroshi et al." should be --Kikuchi et al.--;

Section [75], rewrite to read --Inventors: Hiroshi Kikuchi; Jiro Tanuma; Hideaki Ihsimizu; Chihiro Komori, all of Tokyo, Japan--.

Signed and Sealed this

Fifteenth Day of June, 1993

*Attest:*

Michael K. Kirk

MICHAEL K. KIRK

*Attesting Officer*

*Acting Commissioner of Patents and Trademarks*